United States Patent [19]

Tabler

[11] Patent Number: 4,600,103

[45] Date of Patent: Jul. 15, 1986

[54] SYMMETRICAL BAKERY BASKET

[75] Inventor: Charles P. Tabler, Hamilton, Ohio

[73] Assignees: Buckhorn Material Handling Group, Inc., Milford, Ohio; Ekco Products, Inc., Wheeling, Ill.

[21] Appl. No.: 591,874

[22] Filed: Mar. 21, 1984

[51] Int. Cl.[4] ..... B65D 21/02; B65D 21/04

[52] U.S. Cl. ..... 206/505; 206/507

[58] Field of Search ..... 206/505, 507

[56] References Cited

U.S. PATENT DOCUMENTS

| | | | |
|---|---|---|---|
| 3,207,098 | 9/1965 | Alpert . | |
| 3,219,231 | 11/1965 | Hare . | |
| 3,565,017 | 2/1971 | Jensen . | |
| 3,783,800 | 1/1974 | Bucker . | |
| 3,819,044 | 6/1974 | Bockenstette . | |
| 3,887,073 | 6/1975 | Wilson . | |
| 3,908,852 | 9/1975 | Ricobene | 206/545 |
| 4,189,052 | 2/1980 | Carroll | 206/507 |
| 4,440,303 | 4/1984 | Seager | 206/545 |
| 4,441,615 | 4/1984 | Goodrich | 206/505 |

FOREIGN PATENT DOCUMENTS

| | | |
|---|---|---|
| 52-28300 | 3/1977 | Japan . |

*Primary Examiner*—George E. Lowrance
*Attorney, Agent, or Firm*—Beall Law Offices

[57] ABSTRACT

There is disclosed a one piece synthetic resin molded bakery tray, without moving parts and without any additional parts, that can be stackable at a plurality of levels, and preferably nestable due to top to bottom functional symmetry. Substantial or even identical symmetry may be provided. Such symmetry may also be with respect to rotation of the tray about a central vertical axis. Interlocking portions are provided symmetrically on the top and bottom edges of high side walls, and a bakery product support partition is provided at a midplane of the walls. Stacking ledges may be provided at an intermediate height from the partition on each high wall for cooperating with the interlocking portions to provide an intermediate stacking position. Complementary interlocking portions may be provided on each surface of the partition adjacent each high side wall for cooperation with interlocking portions of the high side walls to obtain a low stacking position. Identical trays may be rotated 90° and nested to place their partitions parallel to each other and more closely spaced than any of the high, intermediate and low stacking positions.

49 Claims, 16 Drawing Figures

SYMMETRICAL BAKERY BASKET

BACKGROUND OF THE INVENTION

The field of the invention is that of bakery trays, for use with a bakery that will produce a variety of bakery products, of different heights. The baked products are placed in trays for storage and transport, and sometimes also for cooling. The trays usually only carry a single layer of bakery products, are rectangular, and dimensioned so that in one plane a fixed plurality may be placed to fill a truck having standard interior dimensions. The bakery products are shipped in the trays to a distribution center or user, and empty trays are placed in trucks for a return trip to the bakery.

Commercially used bakeries trays have been generally of four types, with some bakerys using more than one type of tray.

TYPE I: A plurality of wire trays or shelves are inserted at selected spacings in a rigid frame having opposed shelf supports. This system is very inflexible, in that it is difficult to place the entire frame in a truck, or the trays must be removed from the bakery frame and inserted into truck frames. Also, the frames are of a fixed height and take up just as much room empty as they do full.

TYPE II: Plastic trays replaced the wire trays or shelves. This reduced cost and weight, but still required the rigid frames and had the above-mentioned disadvantages of the first type of bakery product trays.

TYPE III: Plastic trays were designed to be stackable upon themselves, so that the above-mentioned rigid frames could be eliminated. These trays have gained wide acceptance. They may be rotated 90° when empty to assume a low nest position to conserve space when stored or being returned. This type of tray has a fixed stack height, which is designed to be the highest stack height for their usage, and if they are used for smaller bakery products, vertical space will be wasted accordingly. A tray of this type is disclosed in U.S. Pat. Des. No. 211,068, Miles, May 14, 1968.

TYPE IV: Two or more stacking levels have been obtained with bakery trays by employing bails. These bails, usually metal, may flip and/or slide to assume different vertical positions for supporting an upper tray at correspondingly different vertical stack positions. The trays may nest in one position of the bails or 90° nesting may be employed. An example of such a basket is disclosed in U.S. Pat. No. 4,391,369, Stahl et al, July 6, 1983. While this type of basket is capable of self support in a stack, with a plurality of levels, it has not gained wide commercial usage. The moving parts greatly increase the cost of the basket (perhaps two or three times the cost of a one piece basket of TYPE III). Also, the moving parts give the appearance of unreliability and may in fact have a reliability problem. Also, the moving parts greatly complicate the design, construction and maintenance of automatic handling equipment, particularly conveying equipment used in modern bakeries.

SUMMARY

It is an object of the present invention to provide a bakery tray that will overcome the disadvantages noted above and still provide the advantages noted above.

More particularly, it is an object to provide a bakery tray wherein a single basket may be stacked in two, three or more levels, wherein there are no bails or other moving parts, that is the tray is of one piece rigid construction, wherein the trays may nest when empty for conserving space in storage and return, wherein trays may be mass produced cheaply and reliably used for long life, wherein the trays may be easily and reliably handled by automated equipment, and wherein the trays may be easily and reliably handled manually.

The trays are stacked in two, three or more levels to correspondingly contain different height bakery products in an efficient manner, by merely vertically aligning interlocking portions of identical trays and then moving the same vertically into engagement. The trays are molded in one piece of rigid synthetic resin, so that they have no moving parts. The trays have a sufficiently space saving low stacking position that it may be used for the return trip of empty trays, or the trays may be rotated 90° and nested at an even lower position. The trays are at least as cheap to produce and maintain as the trays of the above-mentioned TYPE III, which are the lowest cost production trays to date. The trays are well adapted to automatic and manual handling, because they have functional symmetry (preferably substantially identical symmetry and even identical symmetry) from side to side, back to front, and top to bottom. That is, the automated equipment and manual stacking may be accomplished without concern as to which side is the top or bottom, which side is the right or left, and which side is the front or back.

The bakery tray is molded of synthetic resin in one piece to have a generally rectangular (including a square configuration) shape with opposed high side walls and a support partition joined at a midplane to the high side walls. The high side walls extend above and below the midplane an equal amount and are provided at their outer free edges with symmetrical interlocking portions so that one tray may be stacked on a like tray using its top or bottom and reversing itself in a horizontal plane with respect to its side walls and the remaining two sides.

The high side walls may be offset between adjacent stacked trays so that the partition of each tray engages the free edge of a high side wall of the other tray in a low stacked position, and the partition may be provided with interlocking portions to prevent side shifting in the low stack position.

Interlocking portions may be provided on the high side walls to provide for intermediate stacked positions by engaging the free edge interlocking portions of a like container. Additional stacked positions may be obtained by differently located interlocking portions.

BRIEF DESCRIPTION OF DRAWINGS

Further objects, features and advantages will become more evident from the following description of preferred embodiments, shown in the accompanying drawing, wherein.

DETAILED DESCRIPTION

A first embodiment, with variations, is shown in FIGS. 1-6. The bakery tray is molded in one piece of homogeneous synthetic resin material. There are many such materials commonly employed in bakery trays or injection molded plastic containers in general.

The tray consists of two basic parts, namely, vertical walls and a centrally located horizontal partition wall. The tray has symmetry from top to bottom (functionally and more specifically literally), and may have symmetry from front to back and side to side. At least two, and preferably three or four vertical walls are employed.

Figure 1:
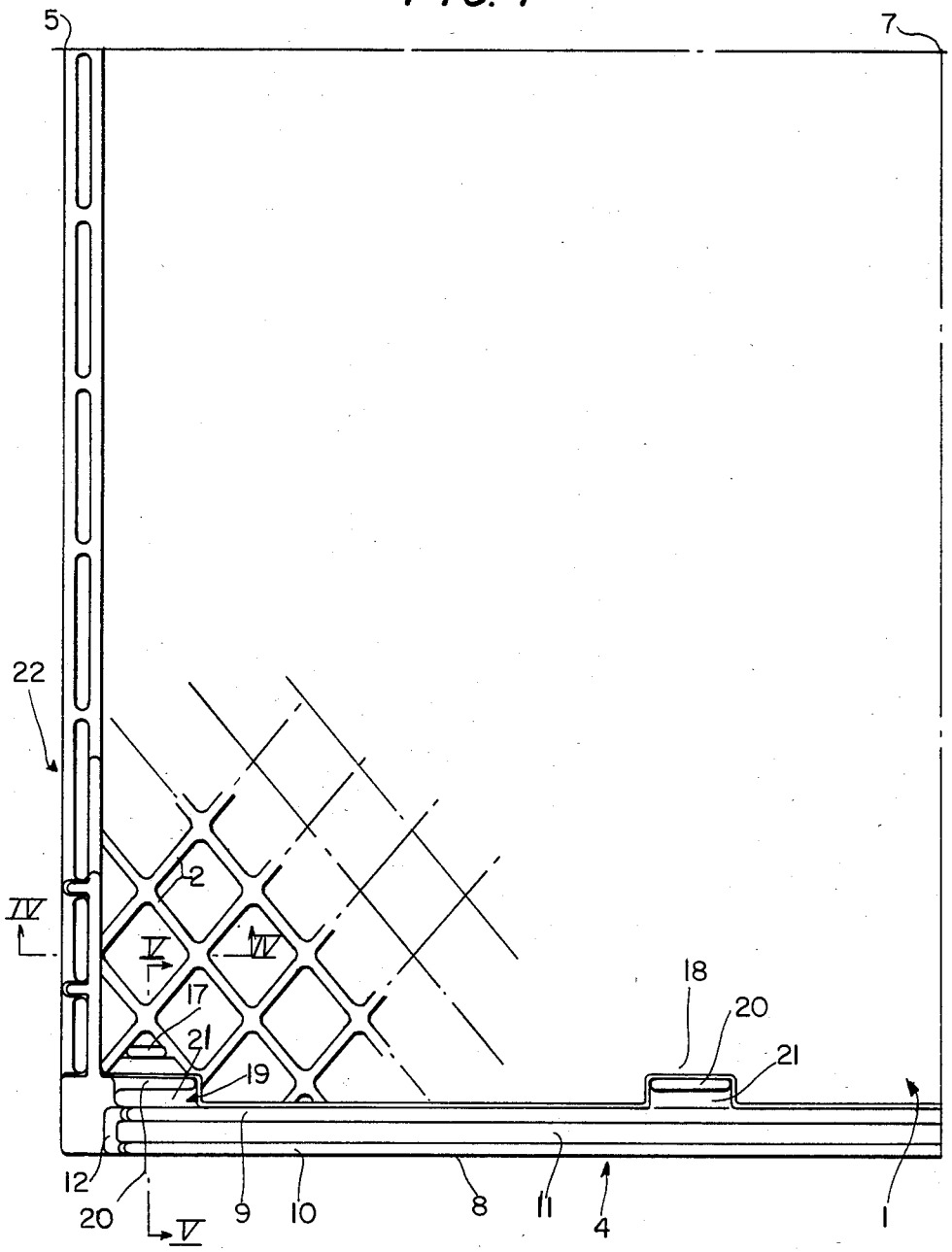
FIG. 1 is a top plan view of one quadrant, namely the lower left hand quadrant when looking at the drawing, of a bakery tray employing the present invention, with all other quadrants having identical symmetry.
Figure 4B:
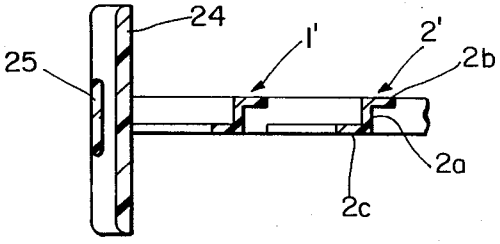
FIG. 4B is a partial cross-sectional view similar to FIG. 4A, but of a variation.
Figure 4A:
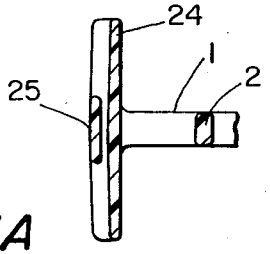
FIG. 4A is a partial cross-sectional view taken along line IV—IV of FIG. 1.
Figure 5:
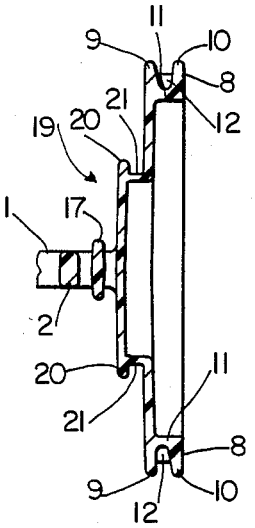
FIG. 5 is a partial cross-sectional view taken along line V—V in FIG. 1.
Figure 6:
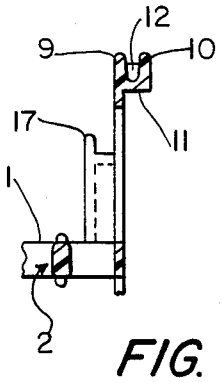
FIG. 6 is a partial cross-sectional view taken along line VI—VI in FIG. 2.

The horizontal partition 1 is generally rectangular in shape, which includes a square shape. The partition may be constructed of solid sheet material, but is more preferably constructed of an open design to permit circulation of air to the bakery products and further to reduce the weight of the bakery basket. As seen in FIG. 1, the open design may take the form of a plurality of diamonds as shown in plan view, formed by a grid of diagonally extending vertical flanges 2. As a variation, the flanges 2 of the grid may extend parallel to the sides of the rectangle, so as to form rectangular or square openings. While it is desirable to have the openings of uniform shape, the shape may vary throughout the partition. The flanges 2 may take on many forms, but preferably are constructed in the nature of a beam: a simple beam structure as shown in FIG. 4A and FIGS. 5 and 6 may be employed, with the greatest dimension of the cross section being vertical to provide greatest beam strength; alternatively, a Z-shape for the beam may be employed as shown with flange 2; in FIG. 4B, wherein a vertical flange **2*a* is integrally joined to top and bottom horizontal flanges 2*b* and 2*c*, which horizontal flanges do not vertically overlap each other so as to provide mold relief, that is, a simple two part mold may be employed with vertical separation in molding the tray; and other beam structures may be employed, such as a I-beam shape (not shown), or a T-shape (not shown). The partition 1 is most preferably symmetrical about a horizontal midplane 3**.

With respect to the present application, the term "symmetry" will have three different meanings, of varying degrees. Identical symmetry will mean that any structure found on one side of the plane of symmetry will be found in identical form on the opposite side of the plane of symmetry and in perfect alignment, within normal tolerances of molding containers. Substantial symmetry will mean that there can be variations of symmetry that do not materially affect the function, use or results obtained with the tray, but may affect its appearance. Functional symmetry may have even more variations between the two sides of the plane of symmetry than substantial symmetry, but the functional symmetry means that a structure on one side of the plane of symmetry will perform such function the same as and obtain the same result of the function as the structure on the other side of the plane of symmetry. Substantial symmtry and functional symmetry, each include both of two types, namely wherein substantially or functionally the same structure is aligned on opposite sides of the plane of symmetry and where functionally and substantially the same structure are reverse images of each other such as would be if a person saw their own image upside down in a mirror with the mirror acting as the plane of symmetry.

At least two sides are provided on opposite sides of the partition. In the first embodiment, two opposite high sides are provided and two opposite low sides are provided. The high sides 4 are functionally symmetrical, preferably substantially symmetrical, and most preferably identically symmetrical with respect to a vertical midplane of symmetry 5. In the first embodiment shown in FIGS. 1-3, the two high sides 4 are identical mirror images of each other. In addition, the high sides are functionally, preferably substantially, and more preferably identically symmetrical with respect to the horizontal midplane 3; in the preferred embodiment, they are exact mirror images of each other with respect to the midplane 3. Further, each high side wall 4 is functionally, preferably substantially, and most preferably identically symmetrical with respect to the vertical midplane 6. In the first embodiment of FIGS. 1-3, each side is divided into identical mirror images with respect to the vertical midplane 6. All of the planes 3, 6 and 5 pass through a common midpoint 7 in the partition 1.

Each high side wall 4 has opposed outer interlocking elements that will interlock with the interlocking elements of a like or preferably identical tray stacked thereon in a high stack position. These interlocking elements 8, in the first embodiment of FIGS. 1-2, take the form of outwardly opening channels having inside walls 9, outside walls 10, web portion 11, and end walls 12. The walls 9 and 10, at the opposite ends, are offset at 13 from the end walls 12.

In the HIGH STACKED position: on one side (not shown), the lower outside wall 10 of the upper tray would fit between the upper walls 9, 10, 12 of the lower tray; and on the other side (shown with respect to the top two trays of FIG. 12), the lower inside wall 9 of the upper tray would fit between the upper walls 9, 10, 12 of the lower tray. In the high stacked position, the webs 11 of the upper and lower trays would respectively engage the walls 9, 10 of the upper and lower trays for supporting the weight of the upper tray, any trays stacked upon the upper tray, and any products carried within the upper trays. The high stacked position is shown with respect to two adjacent topmost trays in FIG. 12. Preferably, alternate trays in a stack of only high stacked trays would be offset from each other in opposite directions, so that the stack would have symmetry and not be off balance in either direction. The spacing A, between adjacent trays in a high stacked position, would be the available height for products contained between such adjacent trays and resting upon the partition of the lower tray. This is sometimes referred to as the "bread position", because its high spacing will permit the carrying of relatively high bread or other similar bakery products. In the high stacked position, the adjacent stacked trays cannot shift horizontally with respect to each other parallel to the plane of FIG. 2, because of the end walls 12 engaging the offset portions 13. Also, the stacked trays of the high stacked position cannot shift horizontally perpendicular to the plane of FIG. 2, because of the interengagement of the walls 9 and 10 between adjacent trays.

Each of the walls 4 is preferably molded with open spaces or cut out areas 13*a*, to reduce the weight of the trays. The vertical ribs 14 and horizontal ribs 15 strengthen the high side walls 4. Open areas 16, together with the horizontal ribs 15 form upper and lower hand hold areas for each wall 4, so that the fingers of a workman may be placed through the open areas 16 and the horizontal ribs 15 used as handles during manipulation of the trays, carrying of the trays, stacking and unstacking of the trays, and like handling.

The trays may also be stacked in a LOW STACK position. The low stacked position is shown with respect to the lowest adjacent trays in FIG. 12, and provides the spacing C between adjacent trays for the carrying of smaller bakery products. This position is also known as the "cake position". In the low stacked position: on one side (not shown), the lower walls 9, 10 of the upper tray fit to either side of a low stack interlocking member, more particularly a flange 17 that extends upwardly from the support surface of the partition 1; on the other side, the upper walls 9, 10 of the lower tray fit on each side of the downwardly depending flange 17 of the upper tray. The interlocking of flanges 17 and walls 9, 10 prevent horizontal shifting of the trays in the plane of FIG. 5, and the fit of the end wall 12 inside the wall 24 prevent horizontal shifting of the trays perpendicular to the plane of FIG. 5. Since these flanges 17 are only used to prevent horizontal shifting, they can be very small and contained only within the corners as shown in FIG. 1. Therefore, they do not materially reduce the available support surface area of the partition for bakery products, and moreover their height can be minimal.

Figure 2:
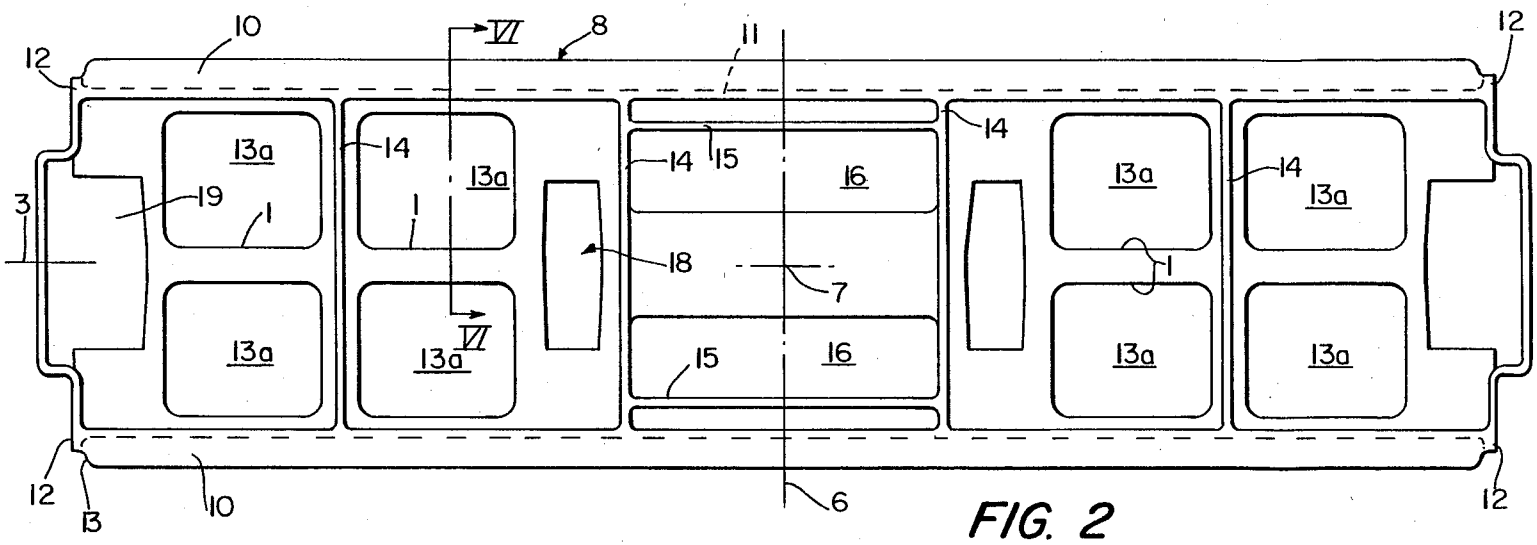
FIG. 2 is an end elevational view of the bakery tray shown in FIG. 1, with the other end being identical.
Figure 3:
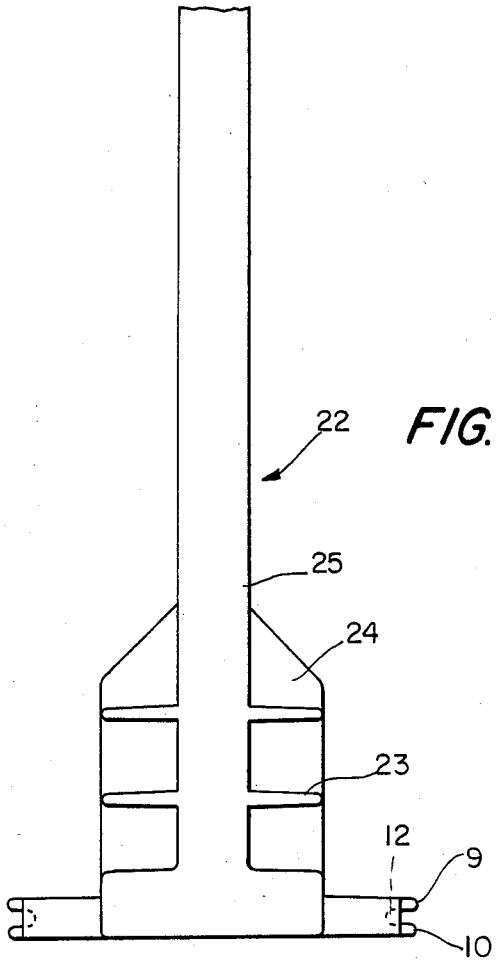
FIG. 3 is a front elevational view of one half of the bakery tray of FIG. 1, with the other half being a mirror image and the back being identical.

It is seen from the above that the top tray of either a high stacked pair of trays or of a low stacked pair of trays may be lifted up, rotated 180 degrees about an axis passing through midpoint 7 and perpendicular to any one of FIG. 2 or FIG. 3 or FIG. 1, and lowered onto the lower tray without changing the functional relationships of the stacked trays. The same is true for the intermediate stacked position to be described.

With the first embodiment of FIGS. 1–3, it is also possible to stack the trays in an INTERMEDIATE STACKED position. While only one intermediate stacked position is shown, it is contemplated that a plurality of intermediate stacked positions can be provided, merely by offsetting, in either of two perpendicular horizontal directions, intermediate interlocking members of different height respectively for the plurality of intermediate positions. Only one intermediate position has been illustrated. The intermediate interlocking members more specifically comprise an inside wall shelf, or shelves. The intermediate interlocking members 18, 19 operate in substantially the same manner, and a cross-sectional view taken through member 18 would be substantially identical to FIG. 5, except that the flange 17 would not be shown in cross-section. Therefore, only intermediate interlocking member 19 will be described in detail. The intermediate interlocking member includes a side wall 20 and a web 21. In the intermediate stacked position, the lower outside wall 10 of the upper tray rests upon the upper web 21 of the lower tray, on one side (not shown); on the other side (shown in FIG. 12, for the middle two trays), the upper outside wall 10 of the lower tray supportingly engages the lower web 21 of the upper tray. As mentioned above, the upper tray may be lifted and rotated about either of two perpendicular horizontal axes or a vertical axis and returned to the intermediate stacked position without any functional difference.

Although not necessary, it is desirable to have opposed side walls 22. These side walls are preferably low enough so that the bakery products can be seen within a stack, possibly removed from the stack, and to save weight. Also, they are high enough, preferably, to prevent the bakery products from sliding off of the support partition 1. Further, these side walls 22 provide rigidity to the tray in the manner of known beam construction. They can be provided with vertical reinforcing flanges 23, high portions 24 that are planar, and low portions 25. It is preferable that the low walls 22 be two in number, although it is possible that only one may exist. It is also preferable that they be functionally symmetrical, more preferably that they be substantially symmetrical, and most preferably that they be identically symmetrical, all with respect to the horizontal midplane 3, the vertical midplane 5, and the vertical midplane 6. Most preferably, they are each composed of exact mirror image proportions with respect to each of the midplanes 3 and 5, and they are exact mirror images with respect to each other about the vertical midplane 6.

It may be noted from FIG. 2, that the high walls 4 are entirely between the inside dimensions of the low walls 22. This structure permits the high walls to enter between the low walls in the low stacked position.

A second embodiment of the present invention is shown in detail in FIGS. 7–10.

Figure 7:
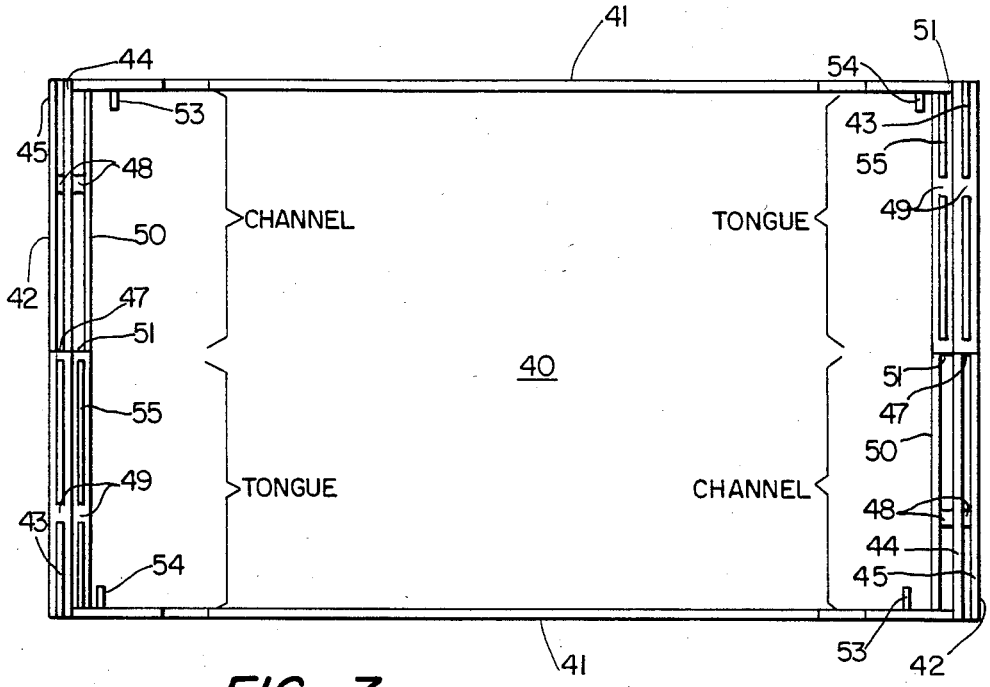
FIG. 7 is a top view, on a reduced scale from that of FIG. 1, of a second embodiment of the present invention.

In the top plan view of FIG. 7, the partition 40 is shown as being a solid planar sheet of plastic, which may be used in the other embodiments and conversely the bottom set forth in the first embodiment may be used in the embodiment of FIGS. 7–10. Low side walls 41 are of simple planar construction, that is of solid single sheet plastic; again, this construction may be used in the other embodiments and conversely the low side wall construction of the other embodiments may be used in this embodiment. Planar single sheet plastic construction for the high side walls is shown in this embodiment; again, a planar construction may be used in the other embodiments and this embodiment may use the open and ribbed type wall construction of the first embodiment for the high side walls 42. The significant feature of the embodiment of FIGS. 7–10, as compared to the other embodiments, lies in the construction of the interlocking means to provide for one or more stacking levels. The significant feature in common with the other embodiments is the functional symmetry of the bakery tray that may stack and/or nest.

While the stationary stacking elements of the embodiment shown in FIGS. 1–6 and 12 took on the form of interlocking channels, the stationary interlocking elements of the embodiment of FIGS. 7–10 take on the form of interlocking tongue and channel elements.

Like the embodiment of FIGS. 1–6, the embodiment of FIGS. 7–10 has functional symmetry and substantial symmetry and identical symmetry about the same midplanes or midaxes (the midplanes of symmetry are the standard cartesian coordinate type planes of x, y, z that pass through the midpoint, point 7 in the first embodiment, of the tray, and the midaxes are the respective axes of intersection of these planes, which would correspond to the standard x, y and z axes or directions), as all the embodiments disclosed herein. According to the broader aspects of the invention, only one or more types of the symmetries may be provided, and further such symmetries may be provided with respect to only one or more of such axes or planes for the bakery tray. One, two, three or more stacking levels may be provided broadly, or with respect to each of the specifically disclosed interlocking elements of the three embodiments, or even their equivalents for a bakery tray.

Figure 8:
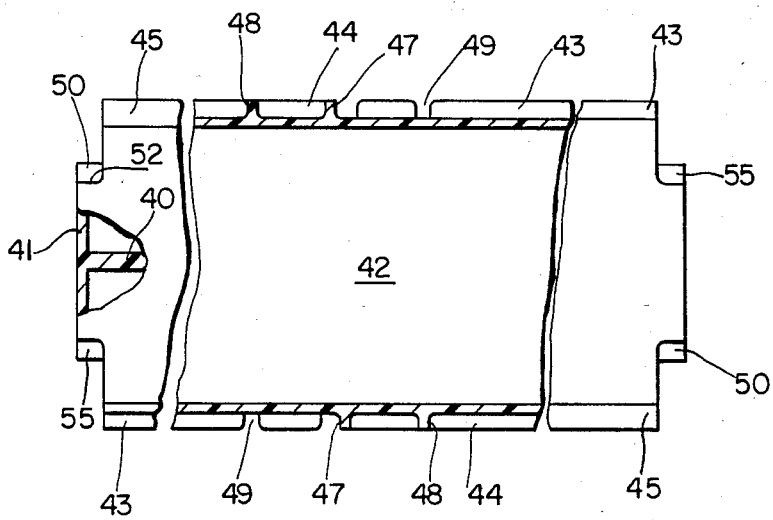
FIG. 8 is an end elevational view of the bakery tray according to FIG. 7, with portions broken away and partly in cross-section.
Figure 9:
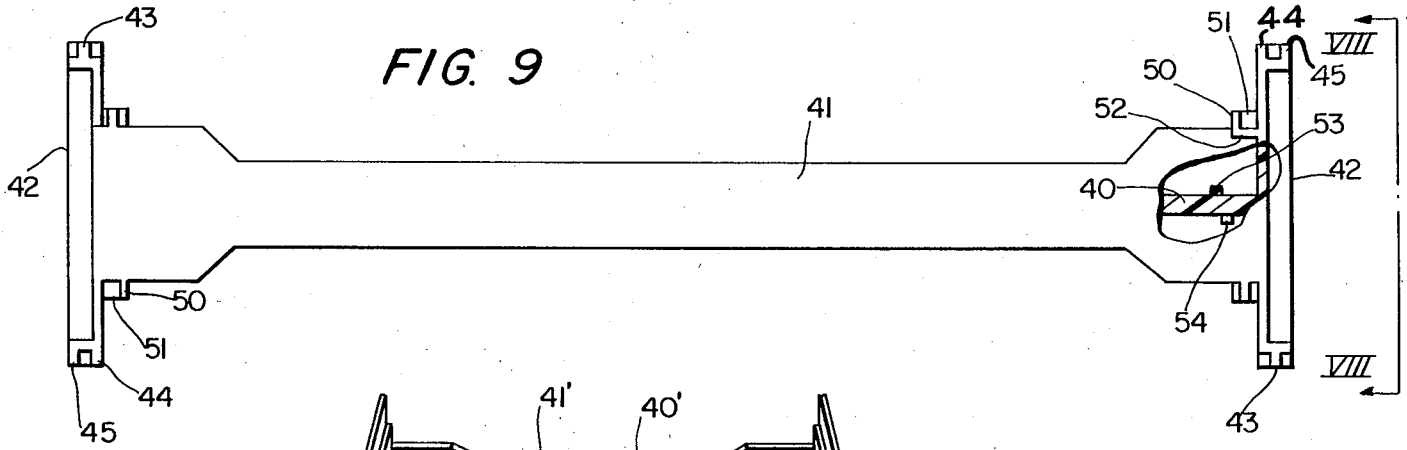
FIG. 9 is a front elevational view of the bakery tray according to FIG. 7, with portions broken away.

In FIG. 7, the stationary stacking elements comprise tongues and channels. The tongues 43, also shown in FIG. 8, are integral flanges that extend upwardly and downwardly from each of the high side walls 42, for approximately one-half of their extent. The same is true for the channels, but for the other half of the extent of the top and bottom of the high side walls 42. The channels and tongues may obviously be smaller, or more of them may be alternated in even numbers or odd numbers, or they may be provided only at the corners.

More specifically, the channels comprise outer walls 45, inner walls 44, end walls 47, and webs shown in cross section in FIG. 8 between the inner and outer walls. Considering FIG. 7 a top view, the bottom would differ only to the extent that a channel would be on the lower portion of the left hand high side wall 42 immediately below the top tongue 43, and a tongue would be on the lower surface of the left hand high side wall 42 immediately above the top channel. The same holds true for the right hand high side wall 42. Therefore, two like or identical bakery trays may be stacked one upon another in a high stacked relationship, as shown by the top two trays in the stack of FIG. 10 in percent vertical alignment with each tongue and channel on the top of the lower tray interengaging with a tongue and channel on the bottom of the upper tray. The tongues 43 between the channel walls 44, 45 prevent horizontal shifting in a direction perpendicular to the high side walls 42. The interengagement of the tongues 43 and the end walls 47 of the channels prevent horizontal shifting of the two trays in a direction parallel to the high side walls 42. That is, the tongues and walls of the channels provide and function as abutments to prevent such horizontal shifting.

Stationary interengaging elements are also provided, respectively, between the top and bottom of the high side walls and the partition, to provide for an intermediate stacking level or position. These intermediate stationary interengaging elements are defined by the main body of the high side wall 42 itself together with channel flanges 50 and channel end wall 51 forming a channel with a web 52, and tongues 55. These intermediate interengaging elements are formed on what might be termed shelves on the sides of the high walls 42. These may be either on the inside as shown, or on the outside of such high side walls 42 (not shown on the outside), or some combination. As shown for the two middle bakery trays in FIG. 10, the tongues 55 may interengage with the channels 50, 51, 52 in an intermediate stack position, and horizontal shifting is prevented in the manner discussed above. In the intermediate stack position, it is seen that the trays are shifted horizontally with respect to each other only in the direction parallel to the low side walls 42. In a stack containing trays stacked only in the intermediate stack position, the trays would be alternately shifted in opposite directions as you proceed up the stack to provide a stable stack.

Figure 10:
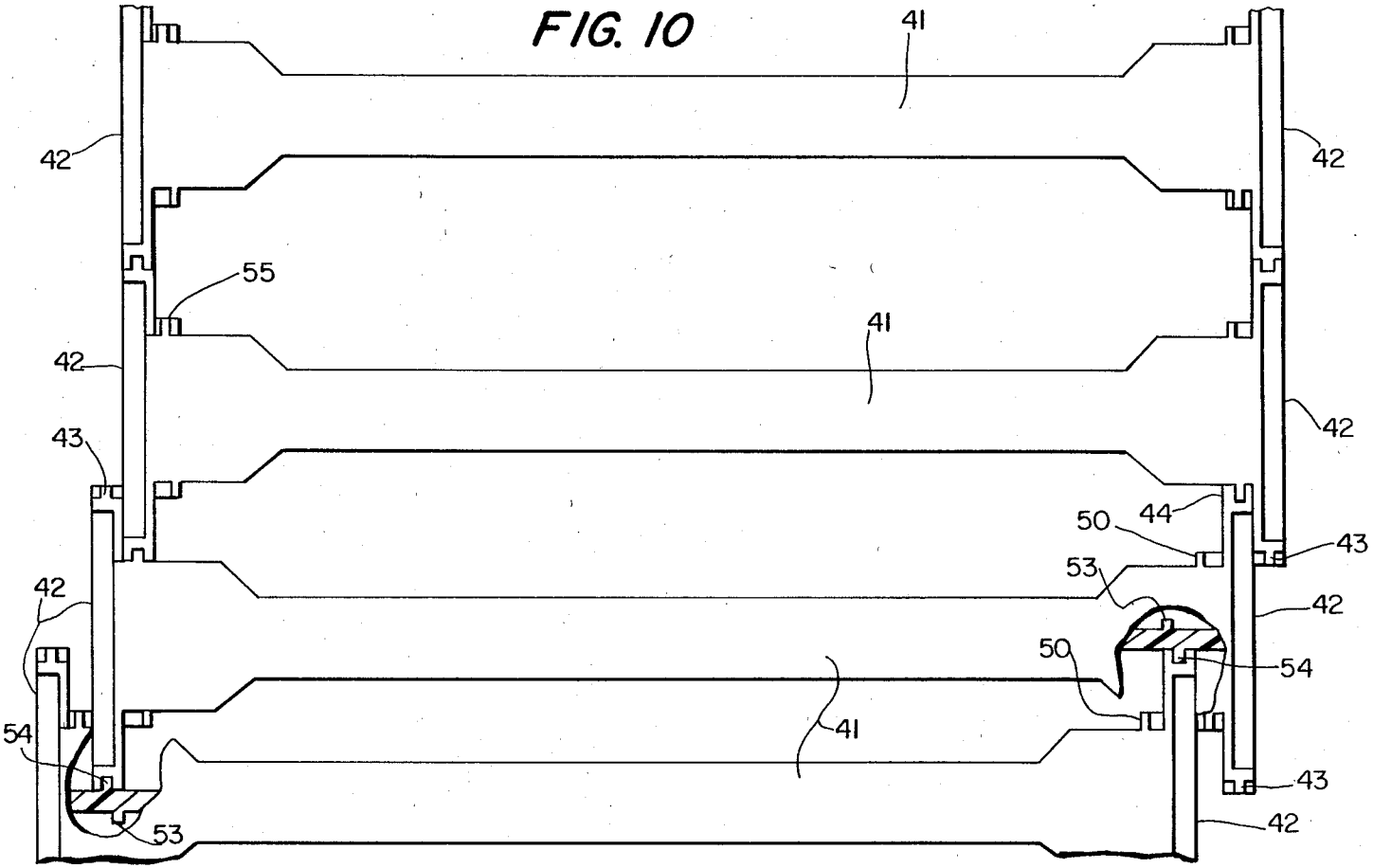
FIG. 10 is a front elevational view of a plurality of trays according to FIG. 7 that are stacked, with portions broken away.

The low stack position is provided by flanges 53 and flanges 54 in the four corners of the partition 40 to function respectively as channels and tongues for interengaging with the channels and tongues 43, 44, 45, 47 of a like tray in the low stack position or level shown with respect to the two bottom trays in FIG. 10. In the low stack position, the two trays are shifted horizontally only in a direction parallel to the low side walls 41 by the amount shown. As a variation, the low stationary interlocking elements 53, 54 that cooperate with the stacking elements 43, 44, 45, 47 may be replaced by equivalent elements on the adjacent surfaces of the high portions of the low stack walls 41. In any event, the weight of the upper tray is carried by the lower tray through contact between the high side walls and the partition 40, therefore, the interengaging elements in the low stacked position may be minimal in length, heighth and strength, because their purpose is to define the position and prevent horizontal shifting.

At times, one bakery would like to have a bakery tray that is not interchangeable with bakery trays provided another bakery, so that the trays will not be confused at a distribution point, or for other reasons. This may be provided by interlocking keys according to the present invention, while providing basically the identical trays to a plurality of bakeries that are produced in substantially identical molds in an economical manner. Such keys are shown in FIGS. 7 and 8. The keying of bakery trays is, with respect to conventional bakery trays, shown in a copending application that is commonly owned with the present application.

Keying for the bakery tray according to the embodiment of FIGS. 7–10 is provided with reinforcing cross flanges or ribs 48 in the channels at a location vertically aligned with a corresponding and mating notch or lock 49 in a tongue 43, 50. It is then seen that an aligned key 48 will fit in a notch or lock 49 to permit the stacking of trays that are similarly keyed. To prevent interchangeability, another bakery might be provided with keys and locks 48, 49 at a different location, so that two trays from the respective two bakeries could not interlock with each other. This is an advantage with respect to the specific second embodiment, but also illustrates that features employed in the past and that may be developed in the future for other purposes may be employed with the present invention.

Other features and functions are apparent with respect to the second embodiment that are in common with the first embodiment, and even the third and fourth embodiment, but they will not be specifically mentioned. Also, different terminology has been used between the two embodiments for corresponding parts, as an example of the breadth of terms that may be used to describe basically the sme or equivalent elements or functions.

Figure 11:
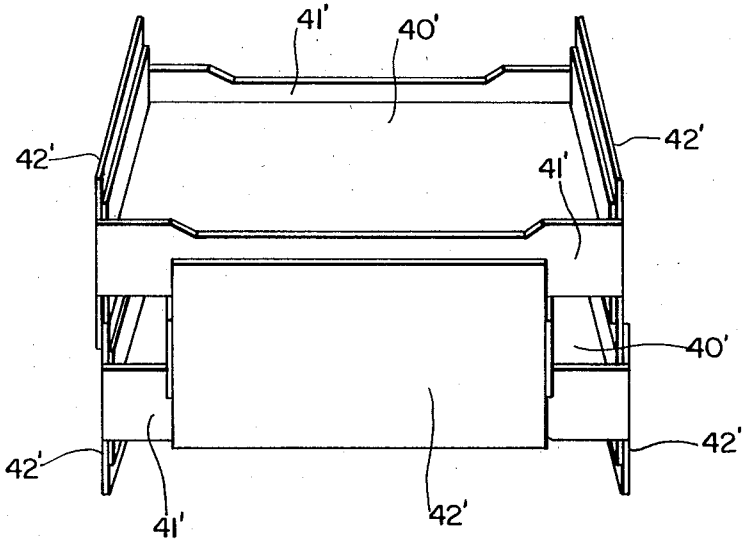
FIG. 11 is a perspective view of three trays in a 90° nested position, which trays are of a third embodiment.

As a further example of the breadth of the present invention, a third embodiment is set forth in FIG. 11. The structure in FIG. 11 differs from the structure of the second embodiment of FIGS. 7–10 in that the stationary interengaging means is not shown. It may be solely of the channel type shown in the first embodiment or the tongue and channel type shown in the second embodiment, which may be broadly considered as involving detents in recesses, or may take out other forms such as conical detents and recesses spaced along the upper and lower surfaces of the high side walls, their shelves, and the adjacent portions of the partition for the respective high, intermediate and low stacking positions. Also, the embodiment of FIG. 11 without any interengaging elements shows that broadly the trays may be merely stacked upon each other, although they would be undesirably subjected to horizontal shifting, which would of course destroy the stack. That is, without interengaging elements, it is seen that the trays of FIG. 11 could horizontally shift with respect to each other in each of the high, intermediate and low stack positions. In FIG. 11, the top and bottom trays are in an intermediate stack position, whereas the middle tray is in a 90° rotated nesting position. It is common for bakery trays that have high and low side walls to be rotated 90° and stacked or nested within each other. The trays of the first three embodiments may also be rotated 90° and nested or stacked, which is particularly desirable when returning empty trays or storing them.

Figure 13:
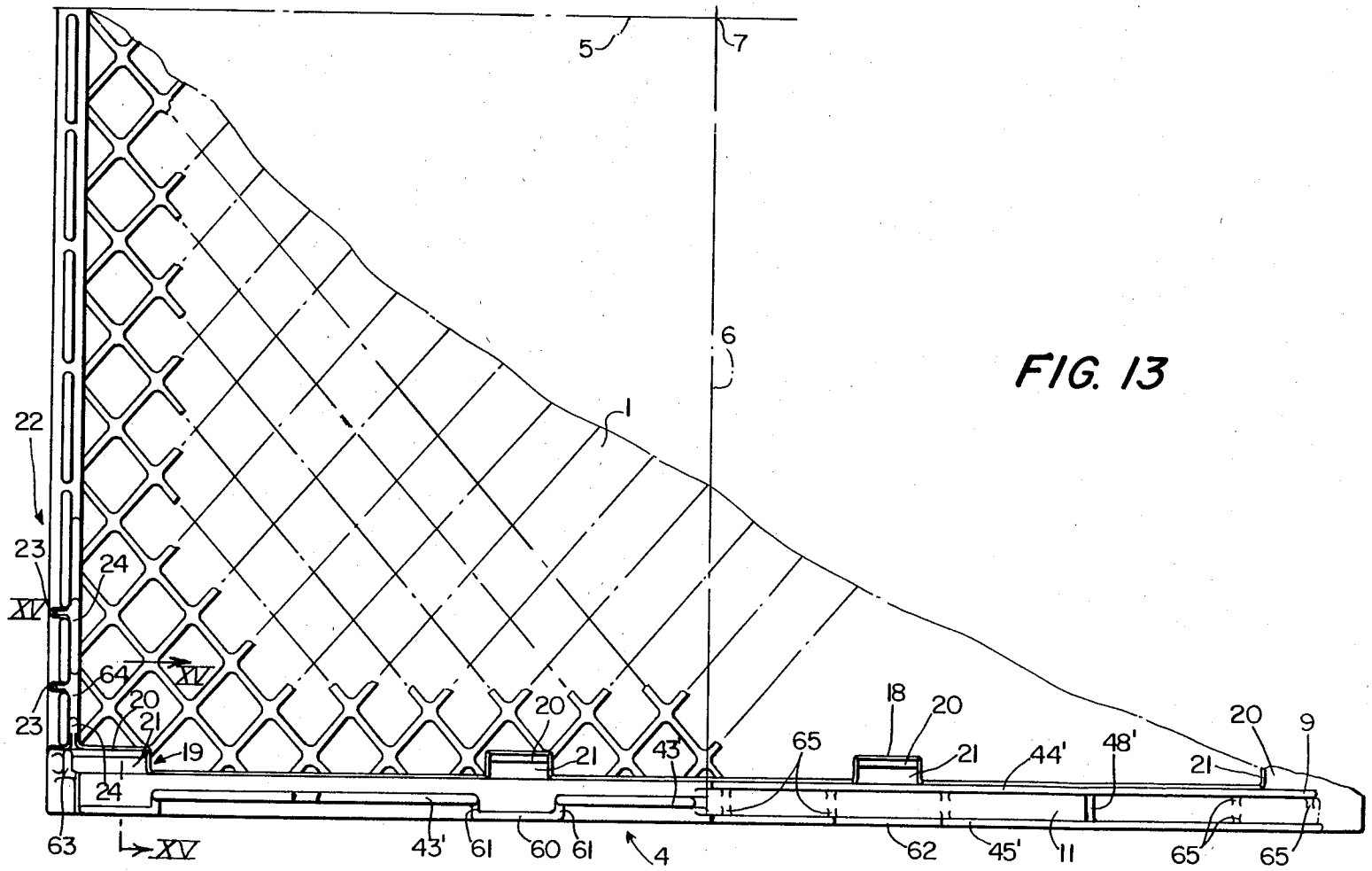
FIG. 13 is a top plan view, corresponding to FIG. 1, with variations, as the most preferred embodiment of the present inventions.
Figure 14:
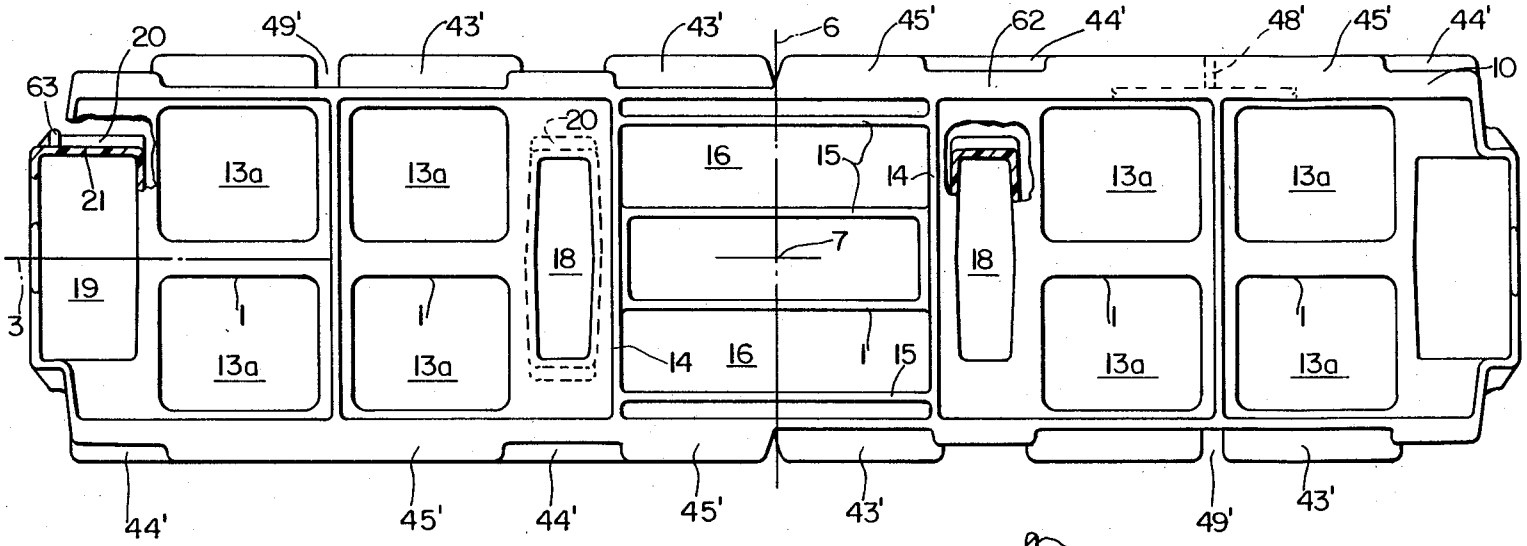
FIG. 14 is an end elevational view of the bakery tray shown in FIG. 13, with the other end being identical.
Figure 15:
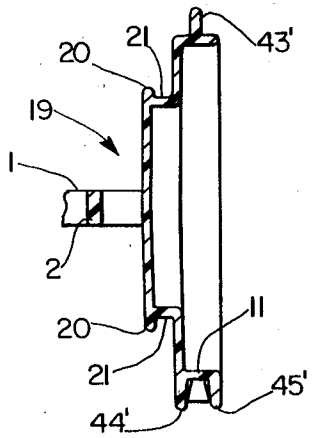
FIG. 15 is a partial cross-sectional view taken along line XV—XV of FIG. 13.

A fourth embodiment, which is the most preferred embodiment, is shown in FIGS. 13–15, as a variation of the first embodiment shown in FIGS. 1–6. That is, this fourth embodiment includes all the structure, function and description of the first embodiment of FIGS. 1–6, except for the specifically noted differences with respect to FIGS. 13–15. In the fourth embodiment, FIGS. 13–15, the structure in common with the first embodiment of FIGS. 1–6 has been shown and referred to by the same numerals. Structure similar to that shown in the second embodiment of FIGS. 7 and 8 has been shown with like numerals having the addition of a prime. The alignment, relationship, and spacing of the tongues and grooves of the embodiment of FIGS. 13–15 is functionally equivalent to that described with respect to FIGS. 7 and 8, to provide complete functional, substantial and identical symmetry about each of the three axes 3, 6, 5.

As shown in FIGS. 13, 14 and 15, a tongue 43' is provided on the top of the high side wall in the lower left hand quadrant of FIG. 13 (a top tongue would be provided on the diametrically opposed quadrant, not shown), and from FIG. 14 it is seen that a tongue is provided diametrically on the lower right hand half of the same side wall. Vertically aligned with each tongue, there is provided a channel composed of side walls 44' and 45' having therebetween the web 11. As described above, keys 48' and locks 49' may be provided if desired, and further provided at different locations for different bakeries.

As seen in FIG. 13, each tongue 43' has a portion removed immediately adjacent each intermediate interlocking member 20, 21 and instead has a U-shaped flange that forms a part of the intermediate locking elements. This U-shaped flange comprises leg flanges 61 and wall flange 60 that are preferably connected to the adjacent portions of the tongue 43' to reinforce the same. These flanges 60, 61, as seen in FIG. 14, are of approximately one-half the height of the tongues 43'. When the trays are placed in any one of their intermediate stacking positions or levels, it will be seen that wall flange 60 will engage on a web 21, and flanges 60, 61 will engage around a side wall 20 of the adjacent tray in the stack for two quadrants; in the other two quadrants, the intermediate interlocking elements 20, 21 will engage a web 11 and a low wall portion 62 of the outer wall 45' of the channel on the adjacent tray. This low wall portion 62 on the outer wall 45' of a channel also has the function of accommodating the flanges 60, 61 of an adjacent tray in the high stack position wherein the tongue 43' is engaged within a channel 45', 44' of an adjacent tray.

The embodiment of FIGS. 13–15 further differs from the embodiment of FIGS. 1–6 in the provision of different abutments for preventing shifting of the trays in the low stack position. More specifically, a vertically extending flange or detent 63, shown in the top left hand portion of FIG. 14, is provided between and connected to the adjacent wall 20 and web 21 of each of the four corner intermediate interlocking elements. The high portions 24 and the cornermost flange 23, adjacent the corner of each side wall 22, is provided with a recess 64 that receives therein the detent 63 when two like trays are in a low stack position. This structure replaces the flange 17 in the embodiment of FIGS. 1–6. The interengagement of the detent 63 in recess 64 will act as abutments to prevent horizontal shifting of adjacent trays in a low stack position, in the horizontal direction perpendicular to the high walls, that is perpendicular to FIG. 14.

The channels 44' and 45' are reinforced by buttress type flanges 65 at a plurality of locations. These buttress flanges 65 are respectively secured to the channel walls 44' and 45' opposite from each other and at a spacing sufficient to receive therebetween the tongue 43' in the high stack position.

From the embodiment of FIGS. 13–15, it is seen that the tongues and grooves may be continuous along the top edges of the high side walls, or broken up into portions, which portions may be spaced from each other. Also, it is possible to have tongues and grooves or channels cover only a small percentage of the top and bottom of the high side walls. Further, in the embodiment of FIGS. 13–15, interlocking has been shown with respect to elements 63 and 64 on the low side walls for at least the low stack position; such is also possible for the intermediate stack position or other stack positions according to the broader aspects of the present invention.

With respect to each of the embodiments, the variations that have been described may be interchangeably employed.

Figure 12:
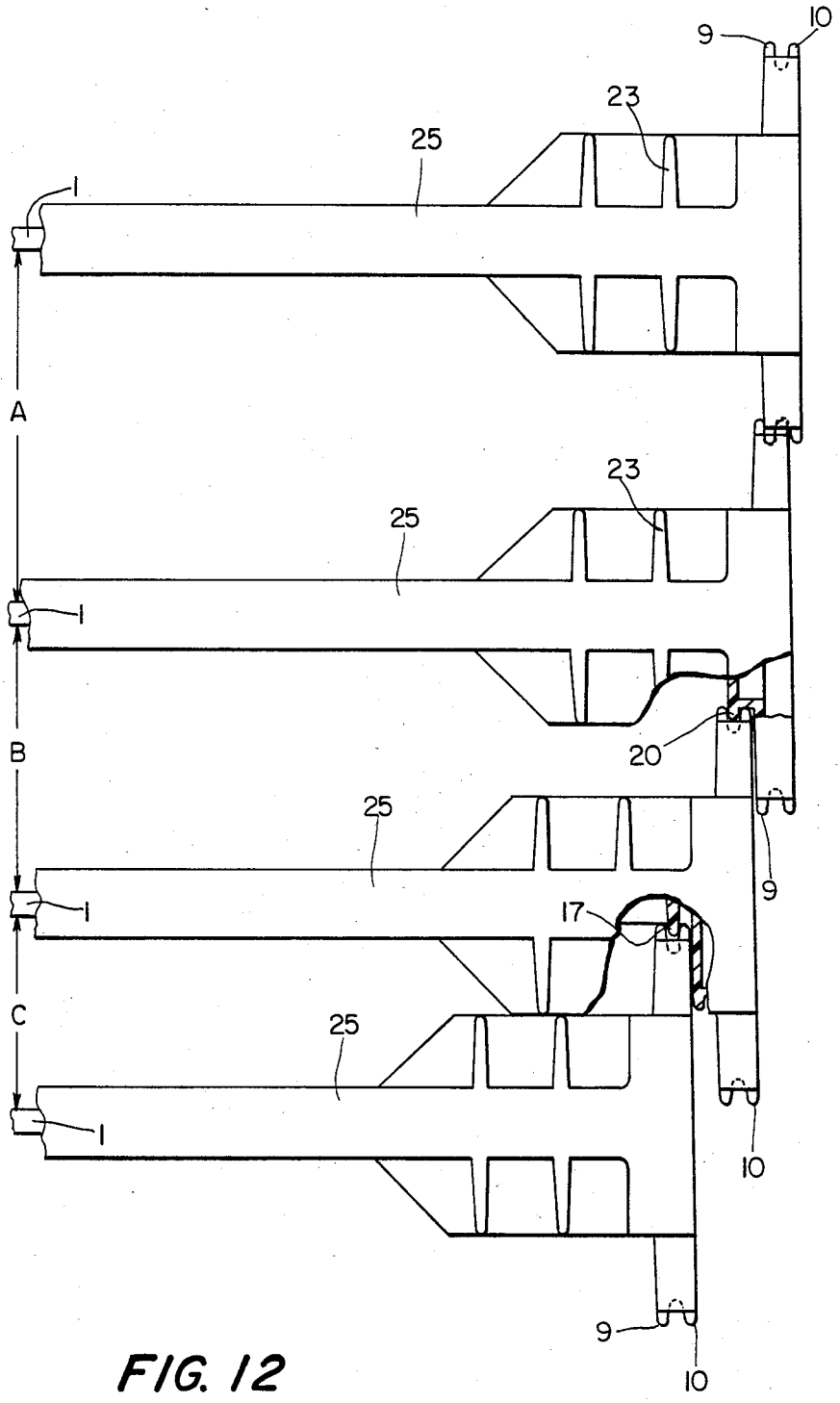
FIG. 12 is an elevational view, corresponding to FIG. 3, but partially showing a plurality of stacked trays.

As specificaly shown in FIG. 12, which is applicable to all the embodiments, it is seen that the high stack position employs a useable spacing between the partitions 1 that has a height A. The intermediate stack position has a useable height between the partitions 1 that is of a dimension B. The useable height between the partitions 1 for the low stack level is C. From FIG. 11, and the known manner of 90° nesting, it may be seen that the corresponding spacing between the partitions for the 90° nest position would be less than the dimension C. The dimension C is less than the dimension B. The dimension B is less than the dimension A. By providing additional interengaging elements, additional levels may be provided as needed.

Due to the height and extent of the interengaging elements 53, 54, 17, they do not materially detract from the useable space within the trays, that is bakery products may be placed upon them without damaging the bakery products and without increasing the height of the bakery products materially. Usually, the height of these elements is so small that they may be accommodated for by the resiliency of the bakery products.

It would appear that the use of the intermediate stacking elements takes away from the interior useable volume of the tray. This is not true in reality. Conventional trays with a bottom will have freely extending high side walls that are effectively twice as long as the freely extending portions of the side walls of the present invention, and therefore the prior art side walls must be made stronger, which usually translates to greater width as being provided by reinforcing ribs or the like. Also, the prior art bakery trays with a bottom have sloping side walls to provide for mold relief in the known manner. Since the side walls of the present invention extend only a small distance above and below the central partition, mold relief is a minimum or not needed at all. These differences between the present invention and the prior art trays save horizontal dimensioning of the high side walls and therefore accommodate the intermediate stacking elements in such saved space, so that the overall effect is that the present invention does not or materially does not take away from the useable interior volume of the tray. Furthermore, the stacking elements, high and intermediate particularly, further function as reinforcement for the high side walls and thereby eliminate the necessity of other conventional reinforcement, which again saves horizontal dimensioning and weight.

In the embodiment of FIGS. 7–10, the trays must be at least one-half overlapped with high side walls engaged, before they can be slid to full high stack level aligned position. This may be improved upon by shortening the tongues and correspondingly lengthening the channels.

While handles have been shown specifically with respect to the first embodiment, it is noted from the other embodiments that they are not essential. Moreover, the high stacking elements in the second embodiment can effectively function as handles.

It is to be noted in all of the embodiments, no rotation for product height change is necessary, which greatly simplifies manual and automatic handling. Ninety degree nesting is provided, but is not necessary due to the very low height of two trays in the low stacked positioning. No moving parts are employed, even though a plurality of stacking levels are available. Further, the trays are constructed homogeneously, that is integrally, of synthetic resin, which also may be expressed as being constructed in one piece. This simplifies molding and reduces cost. Even this is not essential, because it is contemplated that the partition (and perhaps the low side walls) may be molded (perhaps even extruded and cut to length) in one piece and then snap fit together (a snap fit of hot, just molded/extruded parts is easy and cools to a rigid semi-permanent joint) with separately molded (or extruded and cut to length) high side walls (the high and low side walls may be reserved in this analysis); this would increase flexibility in design change and extruding would reduce costs. Without low side walls, extruding could be employed to form trays that would be of only one piece and cut to length from the extrusion.

The trays have symmetry broadly and more specifically have symmetry according to more specific aspects of the present invention. With respect to the preferred embodiments, the trays may be handled manually and automatically without any distinction being made between the front and back, or between the top and bottom, or between the right side and left side for certain functions named, although separately may not be for other functions. This is a great advantage in speed of handling, symplicity of handling, generally cost of handling, both manually and automatically. It is obvious that automated conveying equipment and handling equipment is greatly simplified if it does not have to worry about the orientation of the tray about one, two or three axes.

In the preferred embodiments, different levels are obtained by horizontally shifting adjacent trays in a direction perpendicular to the high side walls. However, more broadly, the shifting may be parallel to the high side walls or diagonally. For example, the high side walls could be constructed as a plurality of spaced, stepped posts, with the steps being in a common plane with the high side walls for engaging different steps for respective different stack levels by horizontal shifting of adjacent trays parallel to such plane. The posts could be connected by low planar sheets that would not interfere in stacking, or by an upper inside partition to top sheet and lower outside partition to bottom sheet.

While the present invention has been specifically described with respect to three embodiments, each with variations employable with the others and modifications, for the specific features of the present invention, they also indicate a breadth for the broader aspects of the present invention, so that the present invention includes both the specific elements and further embodiments, modifications and variations not disclosed, all within the spirit and scope of the following claims.

I claim:

1. A multilevel stacking container comprising:

(a) a horizontal, rectangular support having two pairs of opposed side edges and upper and lower substantially planar faces, (b) opposed vertical side walls integral with one pair of said opposed side edges, said side walls joined to said opposed side edges at a central line bisecting said side walls to divide said opposed side walls into equal upper and lower opposed side walls each having a free end edge opposite said central line, and (c) shelf means substantially parallel to said free end edge on each of said upper and lower opposed side walls, each said shelf means being located between the adjacent said free end edge and said central line, and extending inwardly toward the center of the container, for supporting a like container which may be stacked thereon in a position offset horizontally perpendicularly to said side walls with one side wall upper shelf means of the bottom container being interengaged with the lower end edge of the adjacent side wall of the top container and the upper edge of the opposite side wall of the bottom container being interengaged with the lower shelf means of the adjacent top container side wall, whereby either like container may be removed from the stacked position with the other like container, rotated 180 degrees about a horizontal mid axis and returned to the same stacked position with said other like container.

2. A multilevel stacking container according to claim 1 further comprising:

edge engaging means on each of said free end edges for interlocking with any of the free end edges of a like container when a like container is stacked vertically on said free end edges in a high stack position.

3. A multilevel stacking container according to claim 2 further comprising:

shelf engaging means on each of said shelf means for interlocking with any of said edge engaging means on the free edges of a like container when a like container is stacked vertically on said shelf means in an intermediate stack position.

4. A multilevel stacking container according to claim 3 further comprising:

support engaging means on each planar face of said horizontal rectangular support for interlocking with any of said edge engaging means on the free end edges of a like container when a like container is stacked vertically and horizontally offset on said horizontal support.

5. A multilevel stacking container according to claim 2 further comprising:

support engaging means on each planar face of said horizontal rectangular support for interlocking with any of said edge engaging means on the free end edges of a like container when a like container is stacked vertically and horizontally offset on said horizontal support.

6. A multilevel container according to claim 2 wherein said container is identical with a like container having said upper planar surface positioned to be said lower planar surface and said lower planar surface positioned to be said upper planar surface.

7. A multilevel stacking and nesting container according to claim 2 wherein said container is identical with a like container rotated 180° about a vertical axis through the center of said horizontal support surface.

8. A unitary, rigid, synthetic resin, molded bakery tray consisting of:

a rectangular planar sheet partition;

two high side walls secured to opposite edges of said partition at a midplane of the high side walls, the top and bottom of each of said high side walls having spaced apart vertically outwardly extending detents and recesses, a detent on each top edge being both vertically aligned with a recess on the bottom edge of each high side wall and being horizontally opposite a recess on the top edge of the other high side wall;

the recess on the top of each high side wall being vertically aligned with a detent on the bottom edge of the same high side wall, and being horizontally opposite a detent on the top edge of the other high side wall; and said tray being stackable at a first stacked level with another like tray by interengaging said detents with said recesses in a first position on one tray and indentically in a second position of the one tray rotated 180 about a horizontal mid axis; and a plurality of opposed side wall shelves integrally formed with said high side walls and extending with oppositely directed orientations relative to the center of said tray along opposite ones of said two high side walls in the horizontal direction substantially parallel to corresponding ones of said top and bottom edges of said two high side walls, both above and below the partition and high side wall edge, said shelves being shaped and configured with detents and recesses to thereby enable said tray to be stackable at a second stacked level with another like tray by interengaging said detents with said recesses in a third position of one tray offset horizontally perpendicularly to said high side walls with one side wall upper shelf of the bottom tray being interengaged with the bottom edge of the adjacent side wall of the top tray and the top edge of the opposite side wall of the bottom tray being interengaged with the lower shelf of the adjacent high side wall of the top tray, whereby said tray may be removed from interengagement in the third position with the like tray, rotated by 180 degrees about a horizontal mid axis and be identically stackable in a fourth position of said tray with the like tray.

9. The tray of claim 8 wherein said detents and recesses are sufficiently symmetrically arranged that said trays are stackable with said recesses and detents interengaging at additional positions of the one tray rotated 180° about a vertical mid axis and identically in third and fourth positions of the one tray rotated 180° about mutually perpendicular horizontal mid axes.

10. The tray of claim 9 wherein said high side walls are of a height and dimensioned so that an identical tray may be stacked thereon in a position only horizontally offset in a direction perpendicular to said side walls by an amount so that the bottom edge of the high side wall on the top tray on one side of the stack engages the partition of the lower tray, and on the other side of the stack the top edge of the high side wall of the low tray engages the partition of the top tray to provide a low stacked level position wherein the adjacent partitions are parallel and spaced apart by a distance less than the spacing of said first stacked level positions.

11. The tray of claim 10, wherein at least two of said opposed side wall shelves integrally extend in the horizontal direction both above and below the partition at a position spaced vertically between the adjacent partition and high side wall edge, said shelves being shaped and arranged so that in each of the four positions of the tray it may be stacked in an identical second stacked level position with an identical upper tray that is only horizontally offset a distance midway between the aligned first stacked level positions and the offset low stacked position so that the lower edge of the upper tray interengages in the upper shelves of the lower tray on one side of the stack, and on the other side of the stack the lower shelves of the upper tray interengages with the upper edge of the lower tray, so that the partitions will be parallel and spaced apart a distance between the corresponding spacing from the first stacked positions and low stacked position.

12. The tray of claim 11, further comprised of a plurality of low side walls extending along opposite edges of said partition between said high side walls, wherein said high side walls are spaced apart a distance greater than said low side walls and said low side walls are of a height so that 90 degrees rotation of one tray relative to an identical tray from a vertically aligned position will permit nesting of the two trays with their partitions parallel to each other and spaced apart by a distance substantially less than the corresponding spacing in the low stacked position.

13. A multilevel, stackable, symmetrical bakery tray, comprising:

a horizontal rectangular partition for supporting bakery products of different height, said partition having opposed parallel first edges, opposed parallel second edges that are perpendicular to said first edges and functionally symmetrical upper and lower generally planar bakery product support surfaces extending between all of said edges;

two opposed vertically extending high side walls respectively joined integrally with said first edges along a horizontally extending midplane of the bakery tray so as to extend substantially equally in the vertical direction from said midplane;

high stationary stacking means on the top and bottom of each high side wall for interengaging with, respectively, the bottom and top high stationary stacking means of like containers placed respectively above and below said tray to achieve a high level stack wherein the partitions of vertically adjacent high stacked trays are parallel and spaced a distance apart substantially corresponding to the height of said bakery tray high side walls for receiving therebetween high bakery products; and said high stationary stacking means being functionally symmetrical from top to bottom sufficiently for the middle tray of three high level stacked trays to be removed from an original position in the stack, rotated 180 degrees about a horizontal mid axis and returned to the stack with the same relative alignment between the high stationary stacking means of the stacked trays as existed in the original position to provide the same function as in the original position; and intermediate stationary stacking means substantially parallel to said top and bottom of each high side wall, each said intermediate stationary stacking means being located between the adjacent ones of said corresponding top and bottom of each high side wall and said partition, and extending with oppositely directed orientations relative to the center of said bakery tray along opposite ones of said high side walls in the horizontal direction, both above and below said partition, for supporting a like bakery tray which may be stacked thereon in an intermediate level stack wherein said trays are horizontally offset from each other with one upper intermediate stationary stacking means of the bottom tray being interengaged with the high stationary stacking means on the bottom of the adjacent high side wall of the top tray and high stationary stacking means on the top of the opposite side wall of the bottom tray being interengaged with the lower intermediate stationary stacking means of the adjacent top tray high side wall, whereby either like tray may be removed from a position in an intermediate level stack with the other like tray, rotated 180 degrees about a horizontal mid axis and returned to the same stack position with said other like tray.

14. The tray of claim 13 wherein the tray is entirely constructed unitarily in one piece of molded synthetic resin.

15. The tray of claim 14 wherein all of said partitions, side walls and means being sufficiently functionally symmetrical to permit equality of said stacking upon rotating a tray in a stack 180° about each of two horizontal mid axes and upon rotating 180° about a vertical mid axis.

16. The tray of claim 14 wherein all of said partitions, side walls and means being sufficiently functionally symmetrical to permit equality of said stacking upon rotating a tray in a stack 180° about a horizontal mid axis parallel to said high side walls.

17. The tray of claim 14 wherein all of said partitions, side walls and means being sufficiently functionalized symmetrical to permit equality of said stacking upon rotating a tray in a stack 180° about each of two horizontal said axes and upon rotating 180° about a horizontal mid axis perpendicular to said high side walls.

18. The tray of claim 14 wherein all of said partitions, side walls and means being sufficiently functionally symmetrical to permit equality of said stacking upon rotating a tray in a stack 180° about each of two horizontal said axes and upon rotating 180° about a vertical mid axis.

19. The tray of claim 14 wherein said intermediate stationary stacking means including, for each high side wall, a support shelf extending from its high side wall at a position spaced between the partition and respective adjacent top and bottom of the high side wall at locations on opposite sides of said vertical midplane.

20. The tray of claim 14 wherein said high stationary stacking means including, separately on the top and bottom of each high side wall, at least one vertically outwardly opening recess and at least one vertically outwardly extending detent of a size to mate with said recess, said recess and detent being spaced horizontally equal distances from a vertical midplane of the tray that is perpendicular to the high side walls, said recess and detent for each high side wall being in the same vertical plane for each of the top and bottom of the high side wall, each recess on the top of a high side wall being vertically aligned with a detent on the bottom of the same high side wall and each detent on the top of the high side wall being vertically aligned with a recess in the bottom of the same high side wall.

21. The tray of claim 14 including low stationary stacking means for having the partition of the top tray of a low stack supportingly resting on the top of one high side wall of the lower tray, and the partition of the lower tray supportingly receiving thereon the bottom of the adjacent high side wall of the upper tray.

22. The tray of claim 21 wherein said intermediate stationary stacking means has opposed abutments preventing horizontal shifting of the two stacked trays whereby, in said intermediate level stack two offset stacked trays are disposed so that their partitions are parallel to each other and spaced apart by a distance substantially less than their spacing in the high stack level and greater than one-half the height of a high side wall for receiving therebetween bakery products of intermediate height, and said intermediate stationary stacking means is functionally symmetrical so that the top tray of the offset intermediate stack may be raised vertically, rotated about a horizontal mid axis and vertically returned to the stack in a position with identical functioning.

23. The tray of claim 22 wherein said intermediate stationary stacking means including, for each high side wall, a support shelf extending from its high side wall at a position spaced between the partition and respective adjacent top and bottom of the high side wall at locations on opposite sides of said vertical midplane.

24. The tray of claim 23 wherein said high stationary stacking means includes, separately on the top and bottom of each high side wall, at least one vertically outwardly opening recess and at least one vertically outwardly extending detent of a size to mate with said recess, said recess and detent being spaced horizontal equal distances from a vertical midplane of the tray that is perpendicular to the high side walls, said recess and detent for each high side wall being in the same vertical plane for each of the top and bottom of the high side wall, each recess on the top of a high side wall being vertically aligned with a detent on the bottom of the same high side wall and each detent on the top of the high side wall being vertically aligned with a recess on the bottom of the same high side wall.

25. The tray of claim 24 wherein all of said partitions, side walls and means being sufficiently functionally symmetrical to permit equality of said stacking upon rotating a tray in a stack 180° about each of two horizontal mid axes and upon rotating 180° about a vertical mid axis.

26. The tray of claim 25 wherein each of said stationary stacking means includes means for preventing any relative horizontal shifting of the trays;

including opposed vertically extending low side walls respectively unitarily joined at said horizontal midplane to said second edges of said partitions, said low side walls having a vertical height less than said high side walls and being functionally symmetrical above and below said midplane, and said low side walls being integrally connected along vertical edges to adjacent vertical edges of said high side walls;

including means for nesting two like trays in an orientation wherein said partitions are parallel, the two trays are rotated 90° with respect to each other about a mid vertical axis and they have their mid vertical axes aligned to space their partitions from each other a distance less than the vertical spacing of said partitions in any stacked position for space saving nesting of empty trays.

27. The tray of claim 14 further comprising opposed vertically extending low side walls respectively unitarily joined at said horizontal midplane to said second edges of said partition, said low side walls having a vertical height less than said high side walls and being functionally symmetrical above and below said midplane, and said low side walls being integrally connected along vertical edges to adjacent vertical edges of said high side walls;

including low stationary stacking means for having the partition of the top tray of a low stack supportingly resting on the top of one high side wall of the lower tray, and the partition of the lower tray supportingly receiving thereon the bottom of the adjacent high side wall of the upper tray;

each of said stationary stacking means includes means for preventing any relative horizontal shifting of the trays.

28. The tray of claim 27 wherein all of said partitions, side walls and means being sufficiently functionally symmetrical to permit equality of said stacking upon rotating a tray in a stack 180° about a horizontal mid axis parallel to said high side walls.

29. The tray of claim 27 wherein all of said partitions, side walls and means being sufficiently functionally symmetrical to permit equality of said stacking upon rotating a tray in a stack 180° about each of two horizontal said axes and upon rotating 180° about a horizontal mid axis perpendicular to said high side walls.

30. The tray of claim 29 wherein all of said partitions, side walls and means being sufficiently functionally symmetrical to permit equality of said stacking upon rotating a tray in a stack 180° about a horizontal mid axis parallel to said high side walls.

31. The tray of claim 27 wherein all of said partitions, side walls and means being sufficiently functionally symmetrical to permit equality of said stacking upon rotating a tray in a stack 180° about each of two horizontal said axes and upon rotating 180° about a vertical mid axis.

32. The tray of claim 31 wherein all of said partitions, side walls and means being sufficiently functionally symmetrical to permit equality of said stacking upon rotating a tray in a stack 180° about each of two horizontal said axes and upon rotating 180° about a horizontal mid axis perpendicular to said high side walls.

33. The tray of claim 31 wherein all of said partitions, side walls and means being sufficiently functionally symmetrical to permit equality of said stacking upon rotating a tray in a stack 180° about a horizontal mid axis parallel to said high side walls.

34. The tray of claim 27 wherein all of said partitions, side walls and means being sufficiently functionally symmetrical to permit equality of said stacking upon rotating a tray in a stack 180° about each of two horizontal mid axes and upon rotating 180° about a vertical mid axis.

35. The tray of claim 27 wherein said high stationary stacking means includes, separately on the top and bottom of each high side wall, at least one vertically outwardly opening recess and at least one vertically outwardly extending detent of a size to mate with said recess, said recess and detent being spaced horizontal equal distance from a vertical midplane of the tray that is perpendicular to the high side walls, said recess and detent for each high side wall being in the same vertical plane for each of the top and bottom of the high side wall, each recess on the top of a high side wall being vertically aligned with a detent on the bottom of the same high side wall and each detent on the top of the high side wall being vertically aligned with a recess on the bottom of the same high side wall.

36. The tray of claim 27 wherein intermediate stationary stacking means for supporting two identical trays in an intermediate stack level wherein said trays are horizontally offset from each other, said intermediate stationary stacking means having opposed abutments preventing horizontal shifting of the two stacked trays and said second supporting the two offset stacked trays so that their partitions are parallel to each other and spaced apart a distance substantially less than their spacing in the high stack level and greater than one-half the height of a high side wall for receiving therebetween bakery products of intermediate height, and said intermediate stationary stacking means being functionally symmetrical so that the top tray of the offset intermediate stack may be raised vertically, rotated about a horizontal mid axis and vertically returned to the stack in a position with identical functioning.

37. The tray of claim 36 wherein said intermediate stationary stacking means including, for each high side wall, a support shelf extending from its high side wall at a position spaced between the partition and respective adjacent top and bottom of the high side wall at locations on opposite sides of said vertical midplane.

38. The tray of claim 37 wherein said high stationary stacking means including, separately on the top and bottom of each high side wall, at least one vertically outwardly opening recess and at least one vertically outwardly extending detent of a size to mate with said recess, said recess and detent being spaced horizontal equal distances from a vertical midplane of the tray that is perpendicular to the high side walls, said recess and detent for each high side wall being in the same vertical plane for each of the top and bottom of the high side wall, each recess on the top of a high side wall being vertically aligned with a detent on the bottom of the same high side wall and each detent on the top of the high side wall being vertically aligned with a recess on the bottom of the same high side wall.

39. The tray of claim 37 wherein all of said partitions, side walls and means being sufficiently functionally symmetrical to permit equality of said stacking upon rotating a tray in a stack 180° about each of two horizontal mid axes and upon rotating 180° about a vertical mid axis.

40. The tray of claim 27 wherein intermediate stationary stacking means for supporting two identical trays in an intermediate stack level wherein said trays are horizontally offset from each other, said intermediate stationary stacking means having opposed abutments preventing horizontal shifting of the two stacked trays and said second supporting the two offset stacked trays so that their partitions are parallel to each other and spaced apart a distance substantially less than their spacing in the high stack level and greater than one-half the height of a high side wall for receiving therebetween bakery products of intermediate height, and said intermediate stationary stacking means being functionally symmetrical so that the top tray of the offset intermediate stack may be raised vertically, rotated about a horizontal mid axis and vertically returned to the stack in a position with identical functioning.

41. The tray of claim 40 wherein said intermediate stationary stacking means including, for each high side wall, a support shelf extending from its high side wall at a position spaced between the partition and respective adjacent top and bottom of the high side wall at locations on opposite sides of said vertical midplane.

42. The tray of claim 41 wherein all of said partitions, side walls and means being sufficiently functionally symmetrical to permit equality of said stacking upon rotating a tray in a stack 180° about each of two horizontal mid axes and upon rotating 180° about a vertical mid axis.

43. A multilevel stacking container comprising:

a horizontal, rectangular support having two pairs of opposed side edges and upper and lower substantially planar faces, opposed vertical side walls integral with one pair of said opposed side edges, said side walls joined to said opposed side edges at a central line bisecting said side walls to divide said opposed side walls into equal upper and lower opposed side walls each having a free end edge opposite said central line, and shelf means substantially parallel to said free end edge on each of said upper and lower opposed side walls, each said shelf means being located between the adjacent said free end edge and said central line, and extending with oppositely directed orientations relative to the center of said container, for supporting a like container which may be stacked thereon in a position offset horizontally perpendicularly to said side walls with one side wall upper shelf means on the bottom container being interengaged with the lower end edge of the adjacent side wall of the top container and the upper edge of the opposite side wall of the bottom container being interengaged with the lower shelf means of the adjacent top container side wall, whereby either like container may be removed from the stacked position with the other like container, rotated 180 degrees about a horizontal mid axis and returned to the same stacked position with said other like container.

44. A multilevel stacking container according to claim 43, further comprising:

edge engaging means on each of said free end edges for interlocking with any of the free end edges of a like container when a like container is stacked vertically on said free end edges in a high stack position.

45. A multilevel stacking container according to claim 44, further comprising:

shelf engaging means on each of said shelf means for interlocking with any of said edge engaging means on the free edges of a like container when a like container is stacked vertically on said shelf means in an intermediate stack position.

46. A multilevel stacking container according to claim 45, further comprising:

support engaging means on each planar face of said horizontal rectangular support for interlocking with any of said edge engaging means on the free end edges of a like container when a like container is stacked vertically and horizontally offset on said horizontal support.

47. A multilevel stacking container according to claim 44 further comprising:

support engaging means on each planar face of said horizontal rectangular support for interlocking with any of said edge engaging means on the free end edges of a like container when a like container is stacked vertically and horizontally offset on said horizontal support.

48. A multilevel container according to claim 44, wherein said container is identical with a like container having said upper planar surface positioned to be said lower planar surface and said lower planar surface positioned to be said upper planar surface.

49. A multilevel stacking and nesting container according to claim 44 wherein said container is identical with a like container rotated 180 degrees about a vertical axis through the center of said horizontal support surface.

* * * * *